US008911336B2

(12) United States Patent
Chiu

(10) Patent No.: US 8,911,336 B2
(45) Date of Patent: Dec. 16, 2014

(54) EXERCISE APPARATUS

(75) Inventor: Yung-Chi Chiu, Taichung (TW)

(73) Assignee: Body Action Enterprise Co., Ltd., Taichung Hsien (TW)

( * ) Notice: Subject to any disclaimer, the term of this patent is extended or adjusted under 35 U.S.C. 154(b) by 160 days.

(21) Appl. No.: 13/615,573

(22) Filed: Sep. 13, 2012

(65) Prior Publication Data

US 2013/0345031 A1 Dec. 26, 2013

(30) Foreign Application Priority Data

Jun. 20, 2012 (TW) ..... 101211885 U

(51) Int. Cl.
*A63B 21/04* (2006.01)
*A63B 26/00* (2006.01)

(52) U.S. Cl.
USPC ..... 482/130; 482/129; 482/142

(58) Field of Classification Search
USPC ..... 482/51, 79–80, 92–96, 140–142, 482/121–123, 129–130
See application file for complete search history.

(56) References Cited

U.S. PATENT DOCUMENTS

| | | | | |
|---|---|---|---|---|
| 5,100,131 | A * | 3/1992 | Fong | 482/112 |
| 5,833,590 | A * | 11/1998 | Chiu et al. | 482/142 |
| 7,381,171 | B2 * | 6/2008 | Chen | 482/140 |
| 7,651,452 | B2 * | 1/2010 | Weir et al. | 482/142 |
| D664,615 | S * | 7/2012 | Chuang | D21/690 |
| 2007/0129225 | A1 * | 6/2007 | Hammer | 482/129 |
| 2013/0337984 | A1 * | 12/2013 | Lung | 482/140 |

* cited by examiner

*Primary Examiner* — Oren Ginsberg
*Assistant Examiner* — Megan Anderson
(74) *Attorney, Agent, or Firm* — CKC & Partners Co., Ltd.

(57) ABSTRACT

An exercise apparatus is provided and includes a seat, a curved track, a linker, a backrest, and a replacing force means. The curved track is connected to the seat. A first end of the linker is slidably mounted on the curved track. An end of the backrest is pivotally connected to the seat, and a second end of the linker opposite the first end is pivotally connected to the backrest. An elastic member is used for providing a returning force to return the backrest to a first position.

11 Claims, 6 Drawing Sheets

EXERCISE APPARATUS

RELATED APPLICATIONS

The application claims priority to Taiwan Application Serial Number 101211885, filed Jun. 20, 2012, which is herein incorporated by reference.

BACKGROUND

1. Field of Invention

This invention relates to an exercise apparatus. More particularly, this invention relates to a sit-up exercise apparatus.

2. Description of Related Art

There have been strong sales of exercise equipment in recent years, especially exercise equipment related to performing sit-up exercises. Most conventional exercise equipment of this type includes a seat, a seatback, a sliding wheel, and a spring. The seat is pivotally connected to the seatback. The sliding wheel is located at the backside of the seatback, is abutted against the ground, and undergoes rotation in this state contacting the ground. The spring is connected between the seat and the seatback. The spring provides a replacing force for replacing the seatback back to its original position.

During operation, the aforementioned sliding wheel of the exercise equipment undergoes rotation on the ground, as described above, and may also experience some sliding on the ground. As a result of such sliding, the path of pivotal displacement of the seatback relative to the seat will not be consistently located on a single vertical plane. Therefore, there is structural instability with such a configuration, ultimately resulting in a potentially dangerous situation. In addition, the aforementioned replacing force as well as the exercise resistance force is provided by the spring connected between the seat and the seatback. One consequence of this is that the exercise resistance will be monotonous and unchanging, minimizing the effect of training the muscles.

Moreover, because the sliding wheel is abutted against the ground, as described above, the maximum reclining angle of the seatback will be limited (i.e, angles larger than 80 degrees are typically not possible). Hence, the ability to perform back stretching exercises will be limited, as will the level of exercise intensity.

SUMMARY

An aspect of the present disclosure is to provide an exercise apparatus with high structural stability, and which results in good exercise effectiveness and high exercise intensity, all of which are important considerations when devising exercise apparatuses.

According to an embodiment of the present disclosure, an exercise apparatus includes a seat, a curved track, a linker, a backrest, and a replacing force means. The curved track is connected to the seat. A first end of the linker is slidably mounted on the curved track. An end of the backrest is pivotally connected to the seat, and a second end of the linker opposite the first end is pivotally connected to the backrest. The replacing force means is used for replacing the backrest.

According to one example of this embodiment, the aforementioned replacing force means can be an elastic member which can be interconnected between the seat and the linker, or can be interconnected between the seat and the backrest.

According to another example of this embodiment, the curved track has at least one curved surface, and the first end of the linker may have a saddle. The saddle can be mounted on the curved track and can comprise at least one rolling wheel pivotally disposed therein. The at least one rolling wheel can be rollably abutted against the curved surface.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
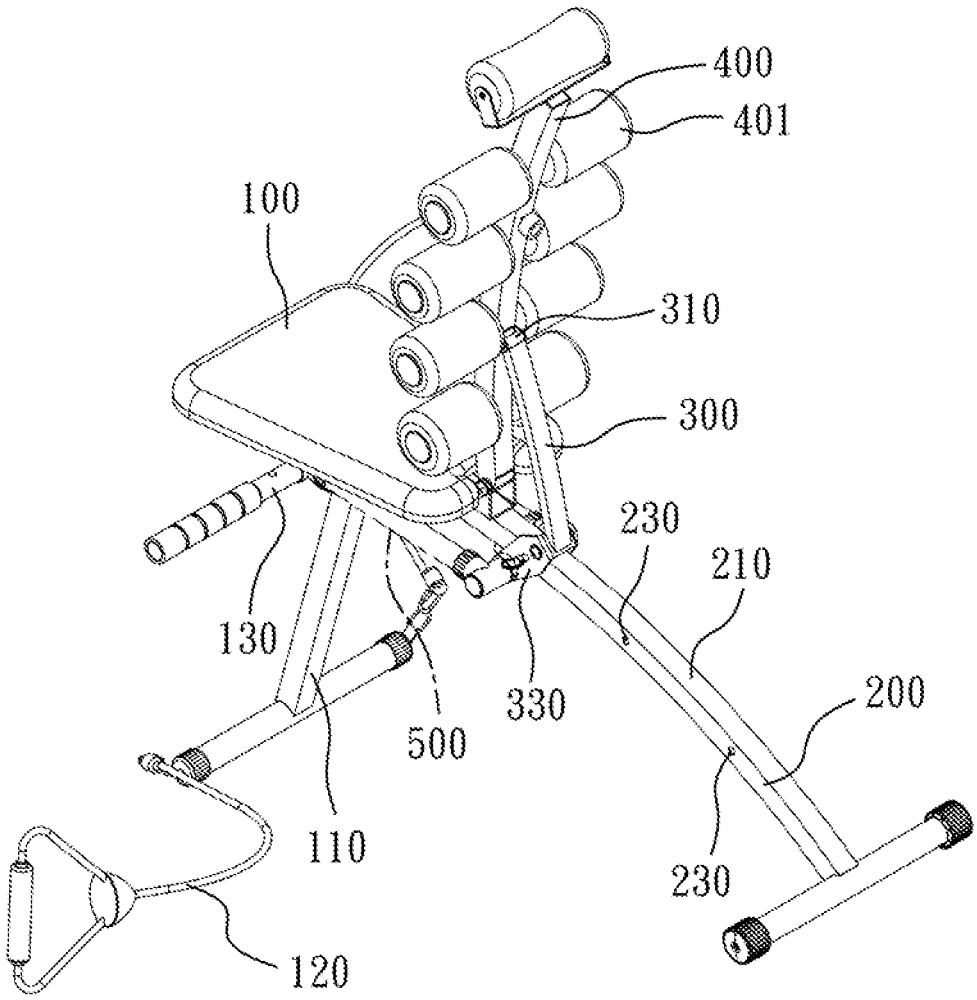
FIG. 1 is a perspective view of an exercise apparatus according to an embodiment of the present disclosure.
Figure 2:
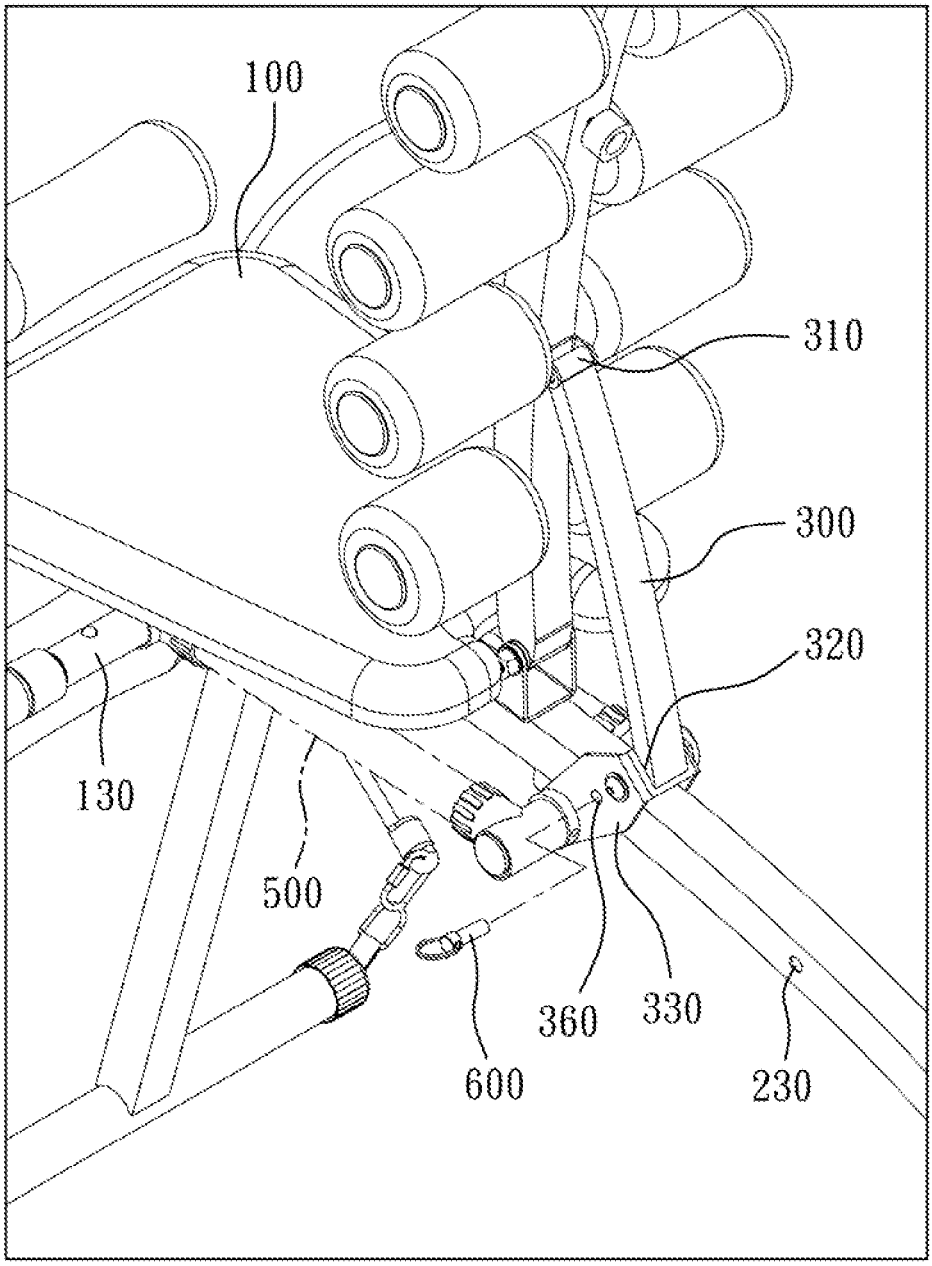
FIG. 2 is an enlarged view of a portion of FIG. 1.
Figure 3:
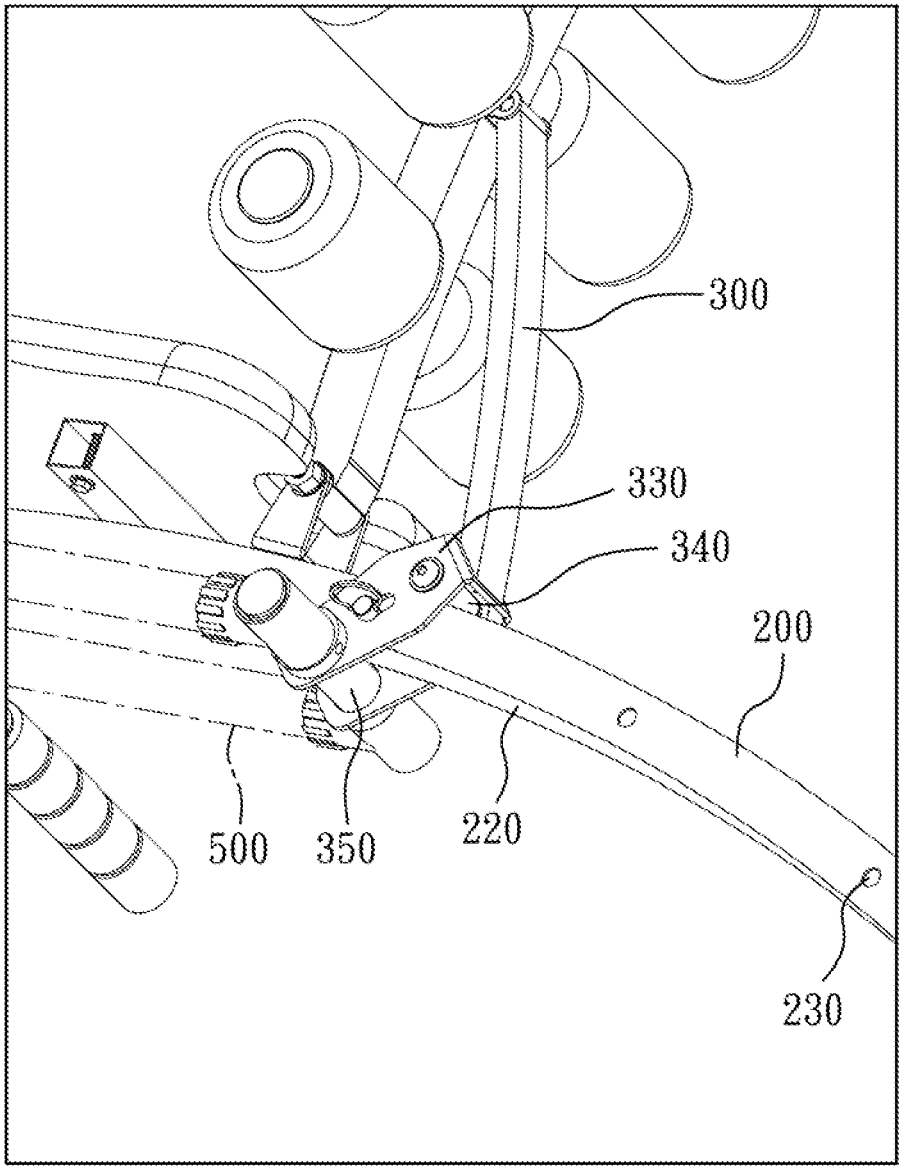
FIG. 3 is an enlarged view of a saddle of FIG. 1.

FIG. 1 is a perspective view of an exercise apparatus according to an embodiment of the present disclosure, FIG. 2 is an enlarged view of a portion of FIG. 1, and FIG. 3 is an enlarged view of a saddle of FIG. 1. An exercise apparatus of the present disclosure is provided. The exercise apparatus is mainly used for sit-up exercises. The exercise apparatus comprises a seat 100, a curved track 200, a linker 300, and a backrest 400. The seat 100 is provided for a user to sit thereon. A stand 110 and a rod 130 are arranged under the seat 100. Two exercise ropes 120 can be installed at both sides of the stand 110, respectively.

The curved track 200 is fixed under the seat 100 and is gradually curved and extended downwardly. In some embodiments, the curved track can also be gradually curved and extended upwardly. Additionally, the curved track 200 is connected to the stand 110. The curved track 200 has a first curved surface 210 facing upwardly, and a second curved surface 220 facing downwardly (see FIG. 3). A plurality of positioning holes 230 are formed through sides of the curved track 200, besides, the positioning holes 230 can be located equidistantly or non-equidistantly.

The linker 300 has a first end 320 and an opposite second end 310. The first end 320 of the linker 300 is pivotally connected to a saddle 330, and the saddle 330 is slidably mounted on the curved track 200. A rolling wheel 340 is pivotally disposed in the upper portion of the saddle 330, and the rolling wheel 340 is rollably abutted against the first curved surface 210 (see FIG. 3). A pivot 350 is pivotally disposed opposing the rolling wheel 340 in the lower portion of the saddle 330, and the pivot 350 is abutted against the second curved surface 220 (see FIG. 3). In addition, in some embodiments, the curved track has a first lateral surface and a second lateral surface opposing the first lateral surface, and the saddle includes a first rolling wheel and a second rolling wheel. The first rolling wheel and the second rolling wheel are pivotally disposed in the saddle and rollably abutted against the first lateral surface and the second lateral surface, respectively, so that the saddle can slide along the curved track. Also, it will be appreciated that the cross section of the curved track can be any geometric shape which the saddle of the linker can be slidably mounted thereon.

A position-limiting hole 360 is formed through the saddle 330 (see FIG. 2), and the position-limiting hole 360 is selectively aligned with the positioning holes 230.

The backrest 400 is connected with the seat 100, and a plurality of soft pads 401 are arranged outwardly along the backrest 400. The aforementioned second end 310 of the linker 300 is pivotally connected to a backside of the backrest 400. The seat 100 and the backrest 400 are pivotally interconnected by the linker 300, and the linker 300 can slide along the curved track 200.

Taking a plurality of elastic members 500 as an example of replacing force means of the present disclosure, the plurality of elastic members 500 are disposed under the seat 100 and connected between the rod 130 and the pivot 350. During pivotal displacement of the backrest 400, a replacing force can be provided by the plurality of elastic members 500 for pulling the linker 300 back to its original position.

Figure 4:
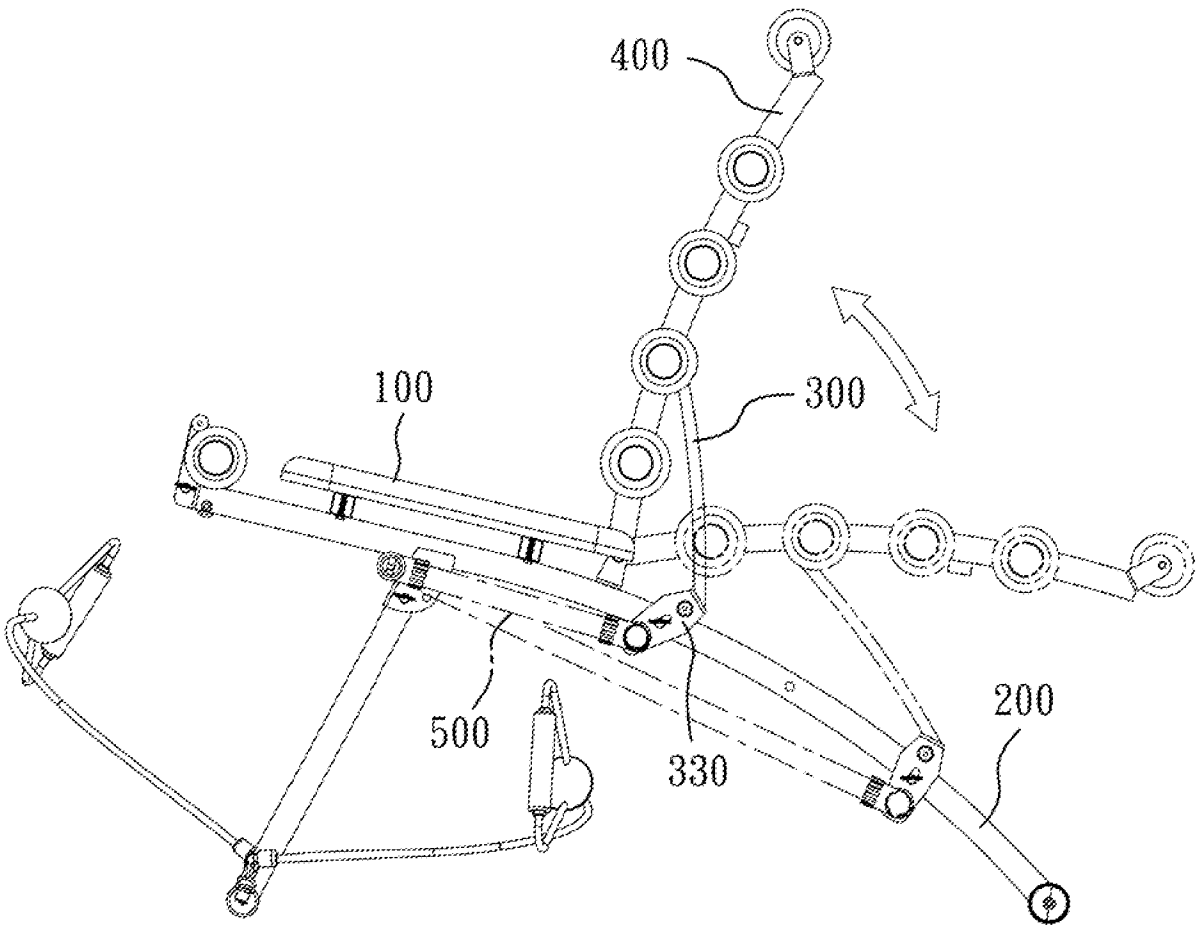
FIG. 4 is a schematic view which shows the exercise apparatus of FIG. 1 in a reclining position.
Figure 5:
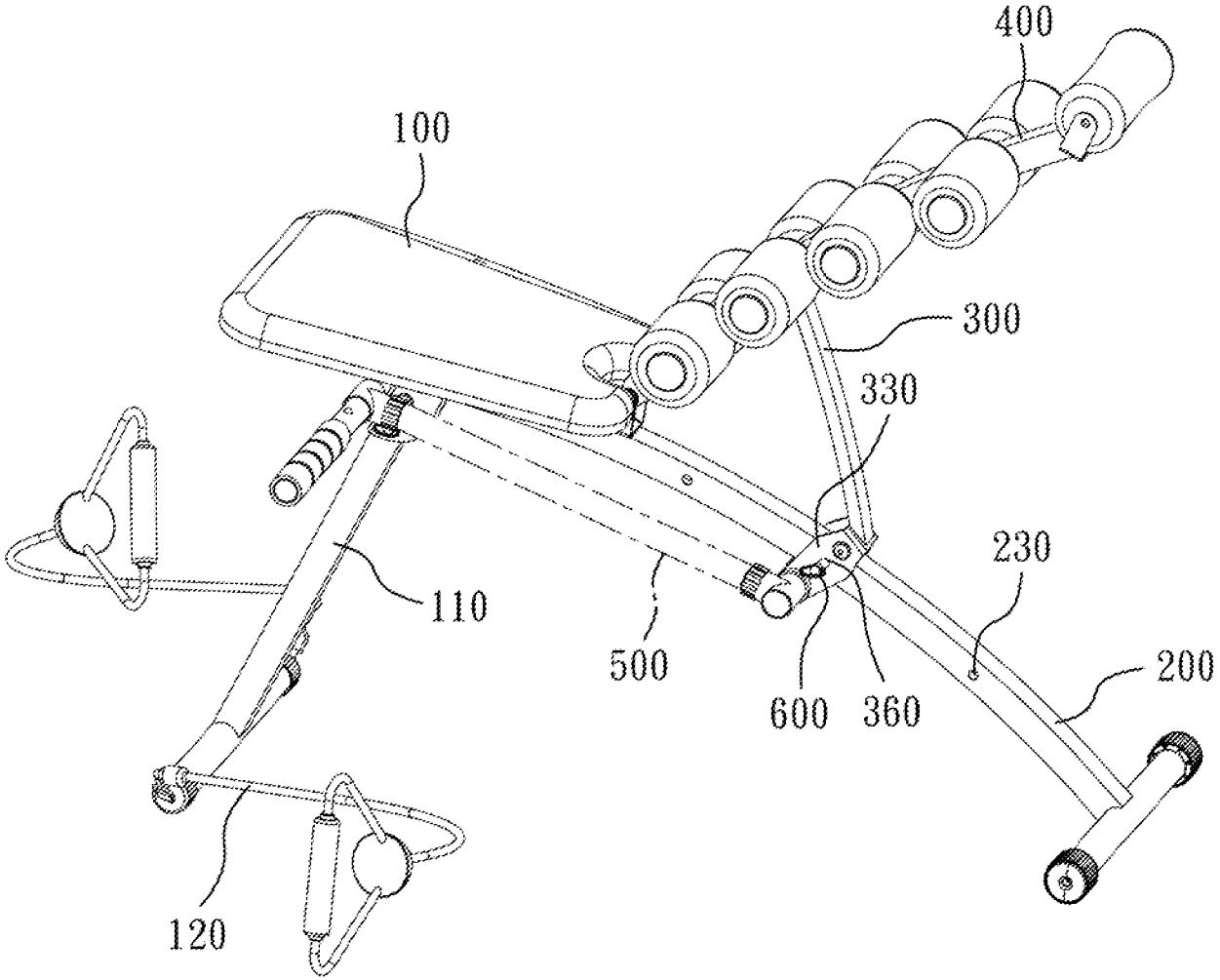
FIG. 5 is a schematic view which shows the exercise apparatus of FIG. 1 in a locking position.

FIG. 4 is a schematic view which shows the exercise apparatus of FIG. 1 in a reclining position, and FIG. 5 is a schematic view which shows the exercise apparatus of FIG. 1 in a locking position. When the backrest 400 is displaced to a reclining position and one of the plurality of positioning holes 230 is aligned with the position-limiting hole 360, a position-limiting member 600 can be inserted through both the position-limiting hole 360 and the positioning hole 230, thus locking the backrest 400 at a desired reclining position.

When the aforementioned position-limiting member 600 is removed, a sit-up exercise may be performed using the exercise apparatus of the present disclosure. During this process, the linker 300 can reciprocatingly slide along the curved track 200 during the pivotal displacement of the backrest 400.

Figure 6:
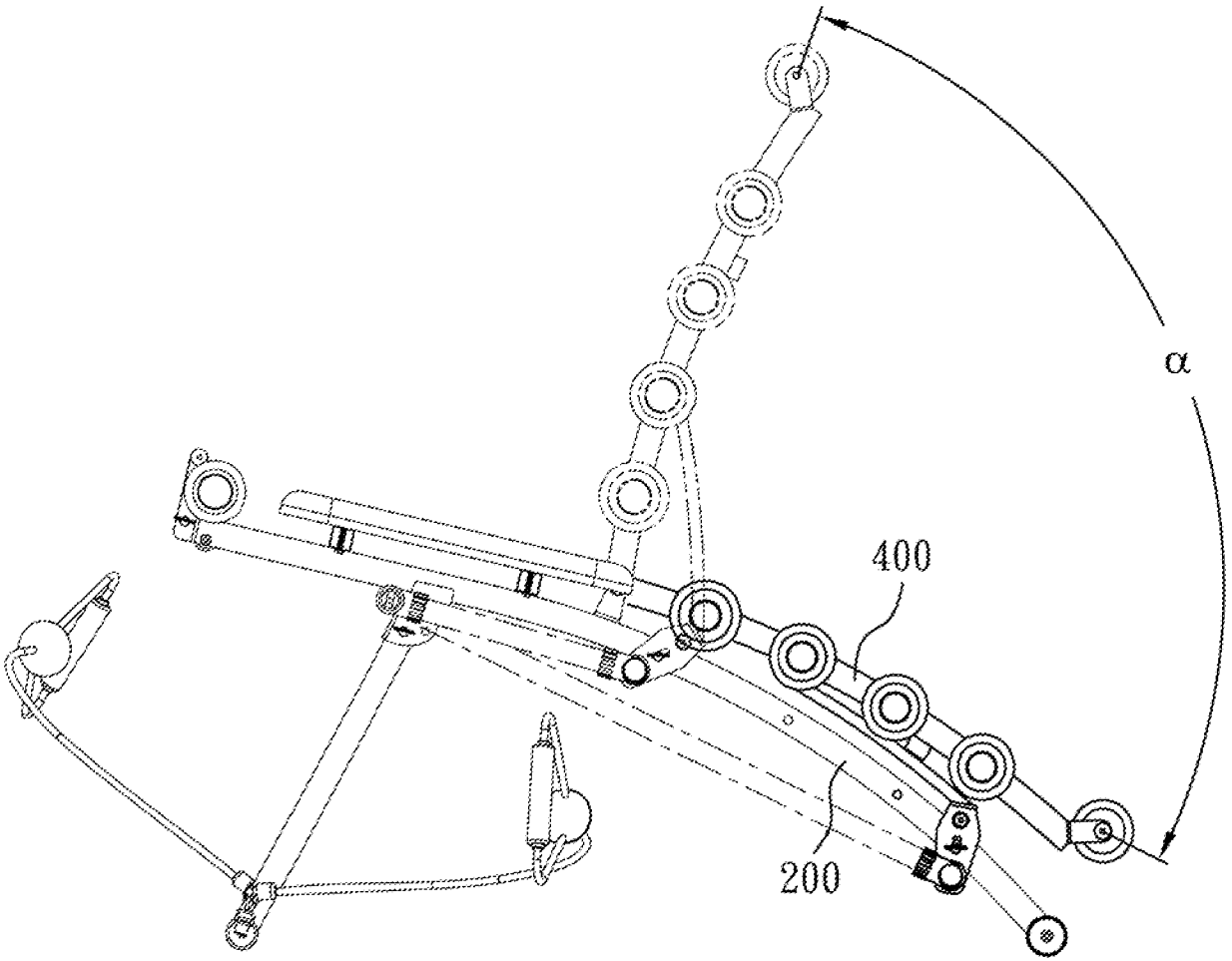
FIG. 6 is a schematic view indicating a reclining angle $\alpha$ of the exercise apparatus of FIG. 1

FIG. 6 is a schematic view indicating a reclining angle $\alpha$ of the exercise apparatus of FIG. 1. As shown in FIG. 6, the curved track 200 of the present disclosure is curved and extended downwardly, and the linker 300 is able to follow the path along the curved track 200 downwardly, so that the backrest 400 can reach a large reclining angle $\alpha$ while pivotally displacing along a trajectory in accordance with the curved track 200. The reclining angle $\alpha$ of the present disclosure is larger than the reclining angle of a seatback of conventional exercise equipment. The reclining angle $\alpha$ can be even larger than 90 degrees, which is not possible with conventional exercise equipment.

In conclusion, the present disclosure has a number of advantages which are listed below.

First, both ends 310, 320 of the linker 300 are pivotally connected to the backrest 400 and the saddle 330 respectively (see FIG. 1), and the saddle 330 is slidably mounted on the curved track 200, so that the linker 300 can be displaced with the pivotal displacement of the backrest 400. In addition, the linker 300 is movably interconnected with the curved track 200 by the saddle 330, so that the trajectory along which the backrest 400 is displaced can be limited by the saddle 330. Moreover, the curved track 200 and the linker 300 can act as supports for the backrest 400, thereby stabilizing the structure during operation.

Second, during operation, the displacing velocity of the backrest 400 can be gradually changed in accordance with the curvature of the curved track 200. Thus, while the backrest 400 is pivotally displaced with the linker 300 sliding along the curved track 200, the replacing force of the backrest 400, which is provided by the plurality of elastic members 500, gradually varies depending on the displacement positions of the backrest 400. Hence, it is possible to provide variable exercise resistances when a user is using the exercise apparatus of the present disclosure, so that the monotonous and unchanging exercising resistance associated with conventional exercise equipment is avoided. Gradual changes of the replacing force can also improve the effectiveness of exercise.

Third, the curved track 200 of the present disclosure is curved and extended downwardly, thereby allowing the linker 300 to follow along the path of the curved track 200 downwardly, so that the backrest 400 can reach a large reclining angle $\alpha$ while pivotally displacing along a trajectory in accordance with the curved track 200. The reclining angle $\alpha$ of the present disclosure is much larger than the reclining angle of a seatback of conventional exercise equipment. Therefore, a stretching exercise can be easily performed, and the exercise intensity can be increased.

It will be apparent to those skilled in the art that various modifications and variations can be made without departing from the scope or spirit of the present invention. Therefore, the scope of the present invention shall be defined by the appended claims.

What is claimed is:

1. An exercise apparatus, comprising:

a seat;

a curved track connected to the seat, wherein the curved track is fixed under the seat and is gradually curved and extended toward a vertical direction;

a linker having a first end and a second end, wherein the first end of the linker is slidably mounted on the curved track, and a distance between the seat and the first end of linker is changeable;

a backrest, wherein an end of the backrest is pivotally connected to the seat, and the second end of the linker is pivotally connected to the backrest; and a replacing force means for providing a returning force to return the backrest to a first position.

2. The exercise apparatus according to claim 1, wherein the curved track is gradually curved and extended upwardly.

3. The exercise apparatus according to claim 1, wherein the curved track is gradually curved and extended downwardly.

4. The exercise apparatus according to claim wherein:

the curved track has at least one curved surface; and the first end of the linker has a saddle mounted on the curved track, the saddle further comprises:

at least one rolling wheel pivotally disposed in the saddle and rollably abutted against the curved surface.

5. The exercise apparatus according to claim 1, wherein:

the curved track has a curved surface and a plurality of positioning holes formed therethrough;

the first end of the linker has a saddle mounted on the curved track the saddle further comprises:

a rolling wheel pivotally disposed in the saddle and rollably abutted against the curved surface; and a position-limiting hole formed through the saddle and which can be aligned selectively with any one of the plurality of positioning holes of the curved track;

a position-limiting member removably inserted into the position-limiting hole and one of the positioning holes of the curved track.

6. The exercise apparatus according to claim 5, wherein the plurality of positioning holes are located equidistantly.

7. The exercise apparatus according to claim 5, wherein the plurality of positioning holes are located non-equidistantly.

8. The exercise apparatus according to claim 1, wherein the replacing force means is an elastic member interconnected between the seat and the linker.

9. The exercise apparatus according to claim 1, wherein the replacing force means is an elastic member interconnected between the seat and the backrest.

10. The exercise apparatus according to claim 1, wherein:

the curved track has a first curved surface facing upwardly, and a second curved surface facing downwardly;

the first end of the linker has a saddle slidably disposed on the curved track, the saddle further comprises:

a rolling wheel pivotally disposed in the saddle and rollably abutted against the first curved surface; and a pivot pivotally disposed opposing the rolling wheel in the saddle and abutted against the second curved surface.

11. The exercise apparatus according to claim 1, wherein:

the curved track has a first lateral surface and a second lateral surface opposing the first lateral surface;

the first end of the linker has a saddle slidably disposed on the curved track, the saddle further comprises:

a first rolling wheel pivotally disposed in the saddle and rollably abutted against the first lateral surface; and a second rolling wheel pivotally disposed opposing the rolling wheel in the saddle and abutted against the second lateral surface.

* * * * *